United States Patent [19]

Cook

[11] 4,214,540

[45] Jul. 29, 1980

[54] VARIABLE PRESSER BAR PRESSURE CONTROL ARRANGEMENT

[75] Inventor: Albert N. Cook, Madison, N.J.

[73] Assignee: The Singer Company, Stamford, Conn.

[21] Appl. No.: 43,779

[22] Filed: May 30, 1979

[51] Int. Cl.[2] ..... D05B 29/00

[52] U.S. Cl. ..... 112/235

[58] Field of Search ..... 112/237, 239, 238, 235

[56] References Cited

U.S. PATENT DOCUMENTS

| | | | |
|---|---|---|---|
| 1,202,224 | 10/1916 | Ringe | 112/237 |
| 2,280,193 | 4/1942 | Le Vesconte | 112/235 |
| 2,827,006 | 3/1958 | Rockerath | 112/235 |
| 3,366,083 | 1/1968 | Ketterer et al. | 112/254 |
| 3,815,529 | 6/1974 | Adams | 112/237 X |
| 3,984,745 | 10/1976 | Minalga | 318/567 |
| 4,016,441 | 4/1977 | Herr et al. | 310/13 |
| 4,056,071 | 11/1977 | Adams | 112/237 |
| 4,067,275 | 1/1978 | Willenbacher | 112/212 |

*Primary Examiner*—Ronald Feldbaum

*Attorney, Agent, or Firm*—Donald P. Gillette; Robert E. Smith; Edward L. Bell

[57] ABSTRACT

A sewing machine having a presser bar operated by a lever having a movable fulcrum to vary the mechanical advantage of the lever and thereby vary the effective pressure on the presser bar.

13 Claims, 7 Drawing Figures

Fig.4
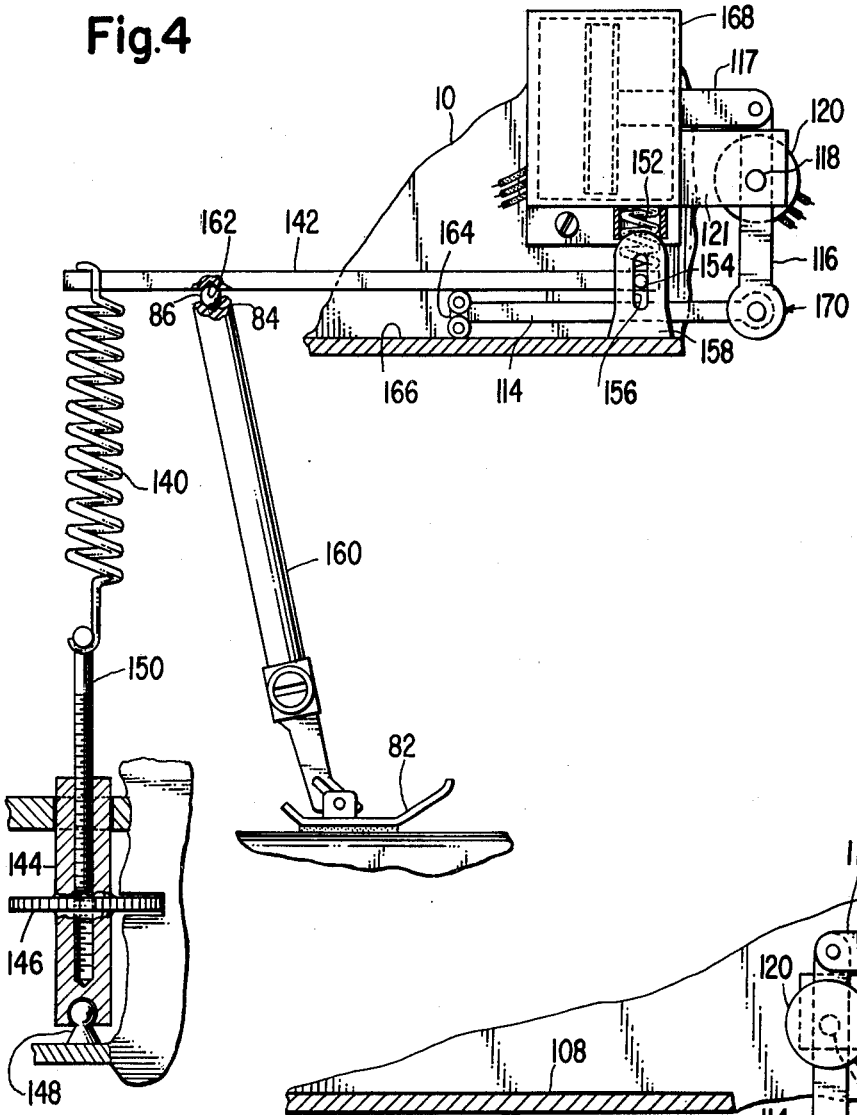
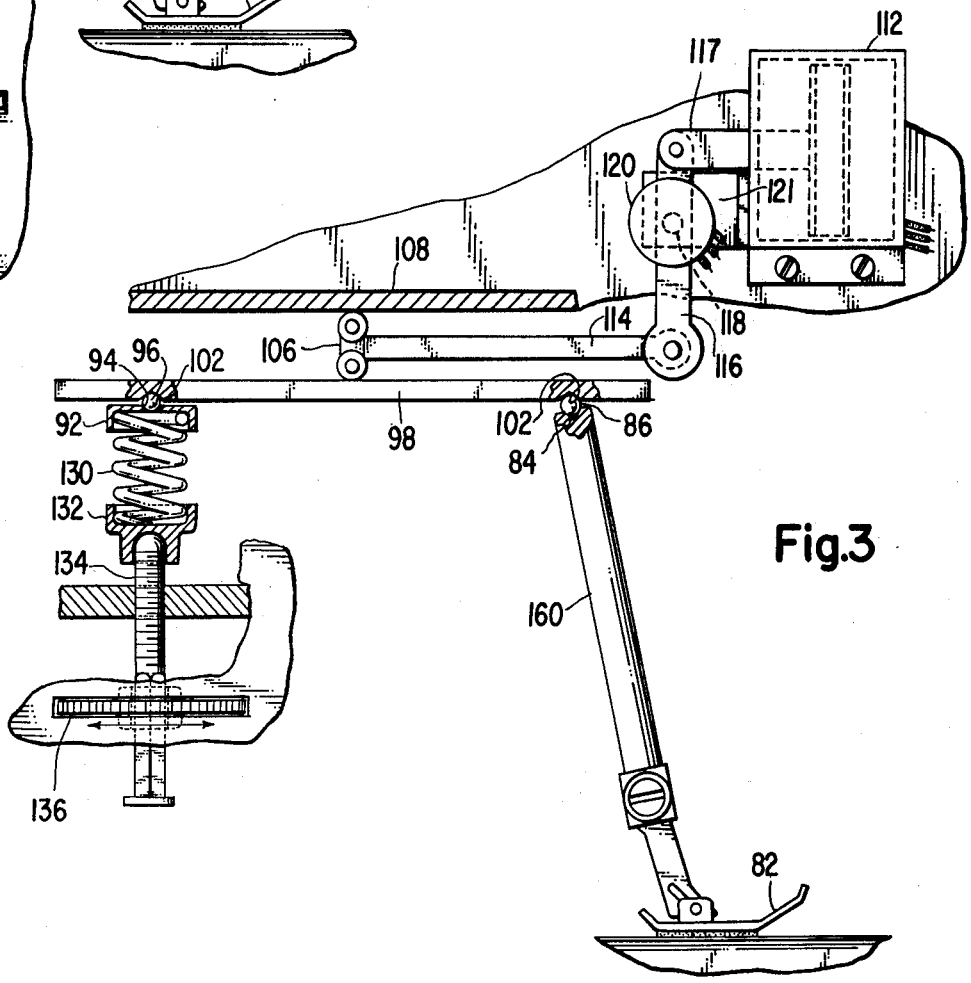
Fig.3

VARIABLE PRESSER BAR PRESSURE CONTROL ARRANGEMENT

DESCRIPTION

BACKGROUND OF THE INVENTION

Sewing machines are equipped with presser bar and presser foot assemblies to press the work piece against the throat plate and the feed dog so that a good needle loop will be formed, and so that the feed dog will carry the material the desired distance between needle penetrations. Many of the inexpensive consumer sewing machines have a presser bar that applies a nonadjustable pressure chosen by the machine manufacturer as the best average setting for common materials. In more expensive machines, manual means may be provided to allow the user to control the presser bar pressure to optimize the pressure for any material being sewn.

Sewing machines now available in which the pattern stitching is electronically controlled include memory devices and electronic logic circuits capable of producing electronic signals for controlling sewing machine functions. It has been suggested that presser bar pressure could be actuated directly by a solenoid controlled, in turn, by electronic signals from such logic circuits. However, the magnitude of force required is so high that the power to operate such direct-acting solenoids is excessive. In addition, their reaction times are too slow.

SUMMARY OF THE INVENTION

An object of this invention is to provide a novel controllable pressure mechanism for a sewing machine pressure bar.

Another object of this invention is to provide a variable presser bar pressure control arrangement which, in use, responds quickly to control signals and yet consumes a minimum amount of power.

These objects are achieved by providing a variable presser bar pressure control mechanism that includes a leverage system having a rigid lever operatively connected to the presser bar, means for applying a predetermined force to a point on the lever spaced from the connection between lever and the presser bar, and means for varying the mechanical advantage of the lever.

BRIEF DESCRIPTION OF THE DRAWINGS

The invention will be described in greater detail with reference to the attached drawings.

FIG. 3 is a front elevational view of a third embodiment of the invention including adjustable spring bias on the presser bar.

FIG. 4 is a fourth embodiment of the invention with a different spring bias mechanism.

DESCRIPTION OF THE PREFERRED EMBODIMENT

Figure 1:
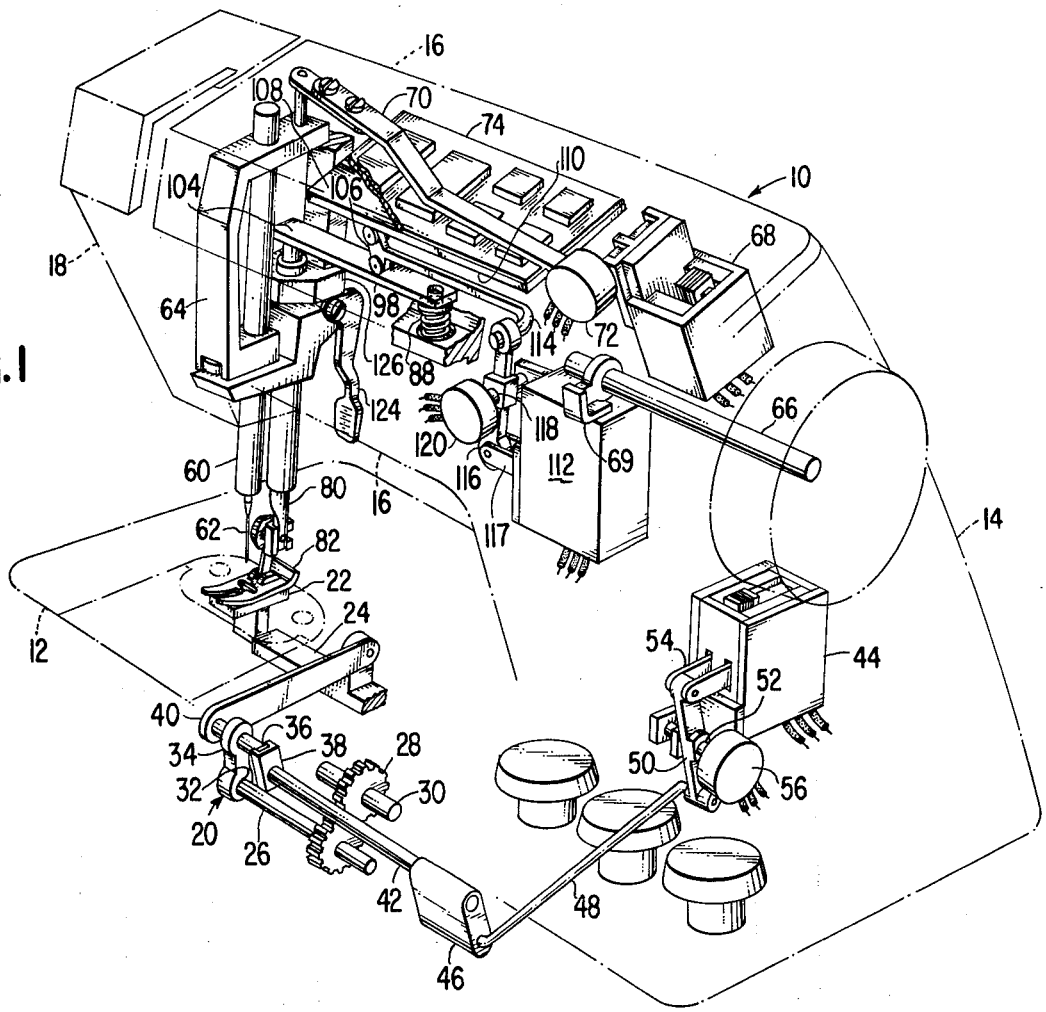
FIG. 1 is a front perspective view of part of the mechanism of a sewing machine, illustrating one embodiment of the invention and showing the exterior of the machine in phantom.

FIG. 1, shows a sewing machine 10 in which standard parts that are not part of this invention are shown in phantom to facilitate an understanding of the spatial relationship of the working mechanism. The parts shown in phantom include a bed 12, a standard 14 that extends upwardly from the bed 12, a bracket arm 16 that extends horizontally form the standard 14 over the bed 12, and a sewing head 18 at the end of the arm.

A standard feed mechanism 20 is housed in the bed 12 and includes a feed dog 22 carried by a feed bar 24. A linkage for imparting work-feeding movement to the feed dog 22 includes a feed drive shaft 26 driven by gears 28 on a bed shaft 30, which, in turn, is driven by a motor (not shown). A cam 32 is mounted on the feed drive shaft 26, and a pitman 34 embraces the cam 32 and is arranged to impart reciprocatory movement to a slide block 36 in a slotted feed-regulating guide 38. A link 40 pivotally connects the pitman 34 with the fed bar 24 so that the magnitude and direction of feed in relation to the motion of the feed dog 22 will be determined by the angle of inclination of the guide.

The angle of inclination of the guide 38 is controlled by a rock shaft 42 secured to the guide and actuated by a linear motor 44. An offset block 46 attached to the rock shaft 42 is pivotally attached to one end of an actuating link 48, the other end of which is pivotally attached to one end of a force-transmitting lever 50. A shaft 52 passes through the central region of the lever 50 and is rigidly attached to it but is journalled for pivotal movement in a support bearing 53. The other end of the lever is pivotally connected to an operating arm 54 of the linear motor 44. The linear motor 44 forms the subject matter of U.S. Pat. No. 4,016,441 of Herr et al, to which reference may be had for greater detail. The arm of a potentiometer 56 is attached to the shaft 52 to indicate the position of the lever 50, as will be described hereinafter.

A needle bar 60 that has a sewing needle 62 attached to its lower end is supported in the sewing head 18. The needle bar 60 is journalled in a needle bar gate 64 and is arranged for reciprocatory and jogging motions. Reciprocatory motion is imparted to the needle bar 60 by a motor (not shown) that transmits power through a standard linkage including an arm shaft 66, which is journalled in the bracket arm 16 and is driven in accurately timed relation to the bed shaft 30. In order to allow for lateral displacement of the needle 62, as is required for the jogging motion, the needle bar gate 64 is mounted to pivot about a substantially vertical axis in the sewing head 18 and jogging motion is imparted to the gate by a linear motor 68, which may be identical to the linear motor 44. The motor 68 is connected to the needle bar gate 64 by known means including an actuating link 70 pivotally attached to a force-transmitting lever, which is not shown but is similar to the force-transmitting lever 50 actuated by the linear motor 44. A potentiometer 72 is attached to the force-transmitting lever of the linear motor 68 to indicate the position of this lever.

The sewing machine 10 further includes electronically logic circuits on a circuit board 74 mounted, for convenience, in the bracket arm 16 for receiving signals from the potentiometers 56 and 72 and for transmitting actuating signals to the linear motors 44 and 68. A pulse generator 69 is mounted adjacent the shaft 66 to generate timing signals to control the operation of electronic logic circuits in combination with the linear motor 44 and 68 for controlling the switch-forming instrumentalities as disclosed in U.S. Pat. No. 3,984,745, which is incorporated herein by reference.

Also supported within the head 18 of the sewing machine 10 is a downwardly baised presser bar 80 having a presser foot 82 pivotally mounted on the lower end thereof. The function of the presser bar 80 and the presser foot 82 is to press downwardly on the material being sewn and urge the material into engagement with the feed dog 22. The presser foot holds the material under the requisite amount of pressure during and after needle penetrations to insure proper feed of the material and proper formation of needle loops in the concatenation of stitches.

Figure 2A:
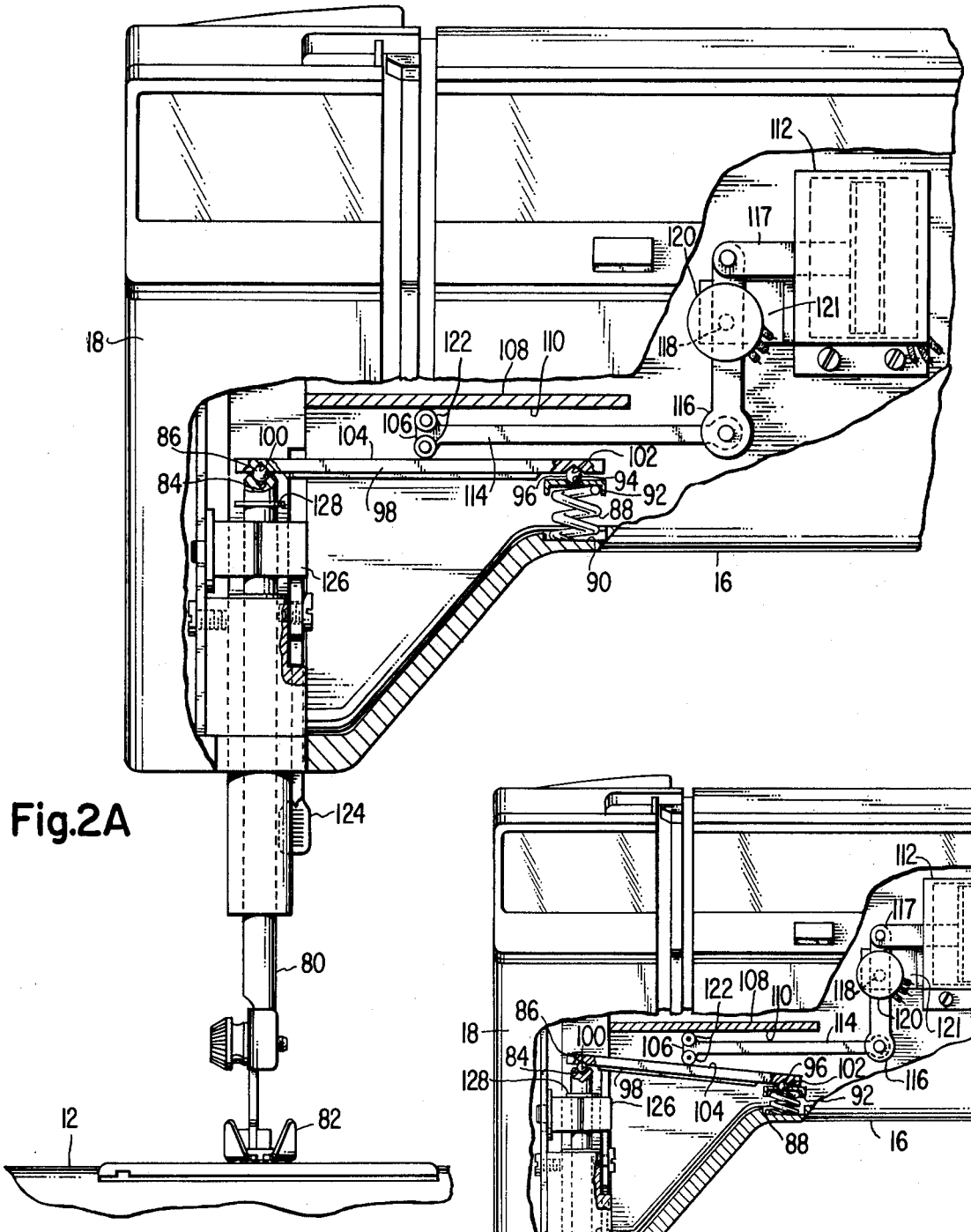
FIGS. 2A and 2B are front elevational views of the head of a sewing machine, partially in section, showing another arrangement of the invention and showing the presser bar in its lowered and raised positions, respectively.
Figure 2B:
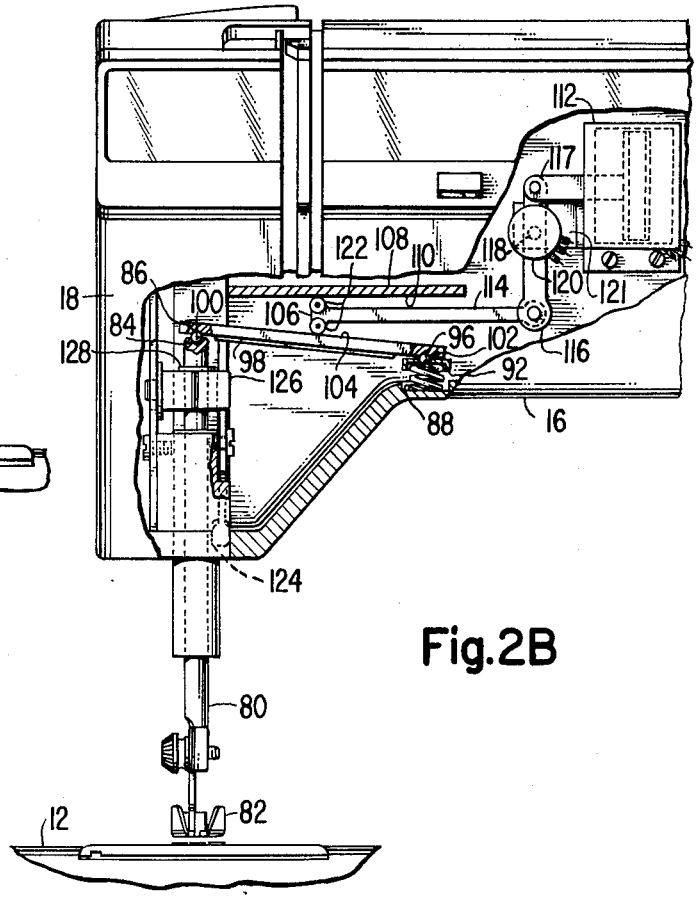

As shown in FIGS. 2A and 2B, the opposite end of the presser bar 80 from the end to which the presser foot 82 is attached has a recess 84 for receiving a ball 86. A vertical compression spring 88 rests in a recess 90 formed in the bracket arm 16 and laterally spaced from the presser bar 80. An end cap 92 rests atop the compression spring 88 and is formed with a seat 94 for receiving another ball 96. A lever 98 in the form of a flat bar rests on the balls 86 and 96, and recesses 100 and 102 are formed in the lower surface of the lever 98 near the ends thereof to receive the balls 86 and 96, respectively. The upwardly facing surface 104 of the lever 98 is smooth and flat so that a shiftable fulcrum 106 may be easily moved along it.

The shifting of the fulcrum 106 varies the relative lengths of the lever arms created between the presser bar 80 and the fulcrum 106, on one hand, and between the fulcrum and the compression spring 88, on the other hand. In order to facilitate varying the relative lengths of the lever arms, the machine has a horizontal support rib 108, which may be integrally formed in the bracket arm 16, with a smooth fulcrum-engaging lower surface 110 against which the fulcrum 106 bears.

A linear motor 112, which may be identical to the linear motors 44 and 68, is provided for shifting the fulcrum 106. An actuating link 114, which may be an extension of the fulcrum 106, is pivotally attached to one end of a force-transmitting lever 116, the other end of which is pivotally attached to the operating arm 117 of the linear motor 112. A shaft 118 of a potentiometer 120 extends through a central region of the lever 116 and is rigidly attached to it. This shaft is journalled in a support 121 to allow pivotal movement of the lever 116, and since the shaft 118 is also the shaft of the potentiometer 120, pivotal movement of the shaft 118 provides an indication of the angular position of the lever 116.

As with the logic circuits that operate the linear motors 44 and 68 utilizing programmed signals and position signals obtained from the potentiometers 56 and 72, the sewing machine 10 includes logic circuits, which will be described hereinafter, to receive signals from the potentiometer 120 and compare those signals with programmed signals to generate pressure related signals to control the linear motor 112. Rollers 122 are mounted to the fulcrum 106 for engaging the surfaces 104 and 110 to minimize the force necessary to shift the fulcrum.

The only difference between the embodiment shown in FIG. 1 and that shown in FIGS. 2A and 2B is that the linear motor 112 in FIG. 1 is below the level of the fulcurm 106 so that the lever 116 extends upwardly, while in FIGS. 2A and 2B the motor 112 is above the level of the fulcrum 106 and the lever 116 extends downwardly. These locations depend on the space available in the machine 10.

In preparing the sewing machine 10 for sewing, it is desirable to raise the presser bar 80 enough to allow the material that is to be sewn to be easily placed under the presser foot 82. A standard lever linkage 124 engages a floating collar 126 embracing the presser bar 80. As shown in FIG. 2B when the lever linkage 124 is raised, the floating collar 126 is also raised, which causes the collar to engage a snap ring 128 attached to the presser bar 80. This engagement lifts the presser bar 80 in opposition to the forces transmitted by the lever 98. It should be noted that the compression spring 88 as shown in FIG. 2B is compressed an additional amount and the lever 98 is displaced angularly in the clockwise direction about the fulcrum 106 to compensate for the raised positon of the presser bar 80.

FIG. 3 shows another embodiment of this invention in which the force exerted by a compression spring 130 may be manually varied to change the range of pressure exerted on an inclined presser bar 160. The bar 160 has the same recess 84 as the vertical presser bar in FIGS. 2A and 2B and presses the same bearing ball 86 into the recess 102. The compression spring 130 rests in a spring seat 132 which may be raised or lowered by a threaded shaft 134 actuated by a thumb wheel 136. The remaining components in this embodiment of the invention are functionally identical with those shown in FIGS. 2A and 2B and have been given identical reference numbers to indicate such identity.

FIG. 4 shows a third embodiment of the invention in which a tension spring 140 exerts downward force at one end of a lever 142. The tensile force exerted by the spring 140 may be varied by the turning of a threaded collar 144, having an integral thumb wheel 146 and anchored to the sewing machine 10 frame by a ball-and-socket joint 148. One end of a threaded shaft 150 is attached to the spring 140 and the other end is threaded into the collar 144. Thus, when the collar 144 is turned by manipulating the thumb wheel 146, the shaft 150 is moved vertically to vary the tension on the spring 140.

The upper surface of the opposite end of the lever 142 presses against a compression spring 152. A pivot pin 154 transversely mounted in the lever 142 adjacent the spring 152 engages an elongated slot 156 vertically formed in a boss 158 on the sewing machine 10 frame, thereby restricting any lateral movement of the lever 142. The ball 86 in the recess 84 at the top of the presser bar 160 engages the lever 142 at a recess 162 formed in the lever 142 and located near the spring 140. A fulcrum 164 engages the lever 142 at some point between the recess 162 and the pivot pin 154 and bears against a fulcrum bearing surface 166 horizontally formed in the sewing machine 10 below the lever 142. A linear motor 168 is provided for positioning the fulcrum 164 through a suitable linkage 170. The motor 168 is placed so that it faces in the opposite direction from the motor 112 in FIG. 3.

Figure 5:
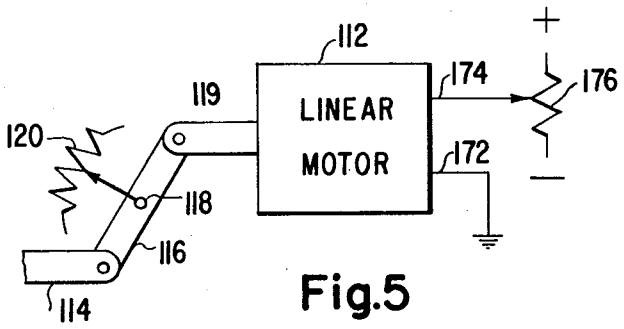
FIG. 5 is a schematic representation of a circuit for operating the presser bar motor to control pressure on the material being sewn.

FIG. 5 shows a simplified circuit for operating the linear motor 112 to control the pressure on the presser bar in any of the embodiments in FIGS. 1–4. The linear motor 112 has two input terminals 172 and 174 through which it receives operating current. The terminal 172 is grounded and the terminal 174 is connected to the arm of a potentiometer 176. The ends of the potentiometer 176 are connected to positive and negative voltages with respect to ground so that movement of the arm can cause current to flow through the coil in the motor 112 in either direction and in a controllable amount to actuate the operating arm 119 and thereby control the lever 116 and the actuating link 114. The potentiometer 120 is shown in schematic form with the arm of the potentiometer connected to the shaft 118 but also serves as an axle for the lever 116.

Figure 6:
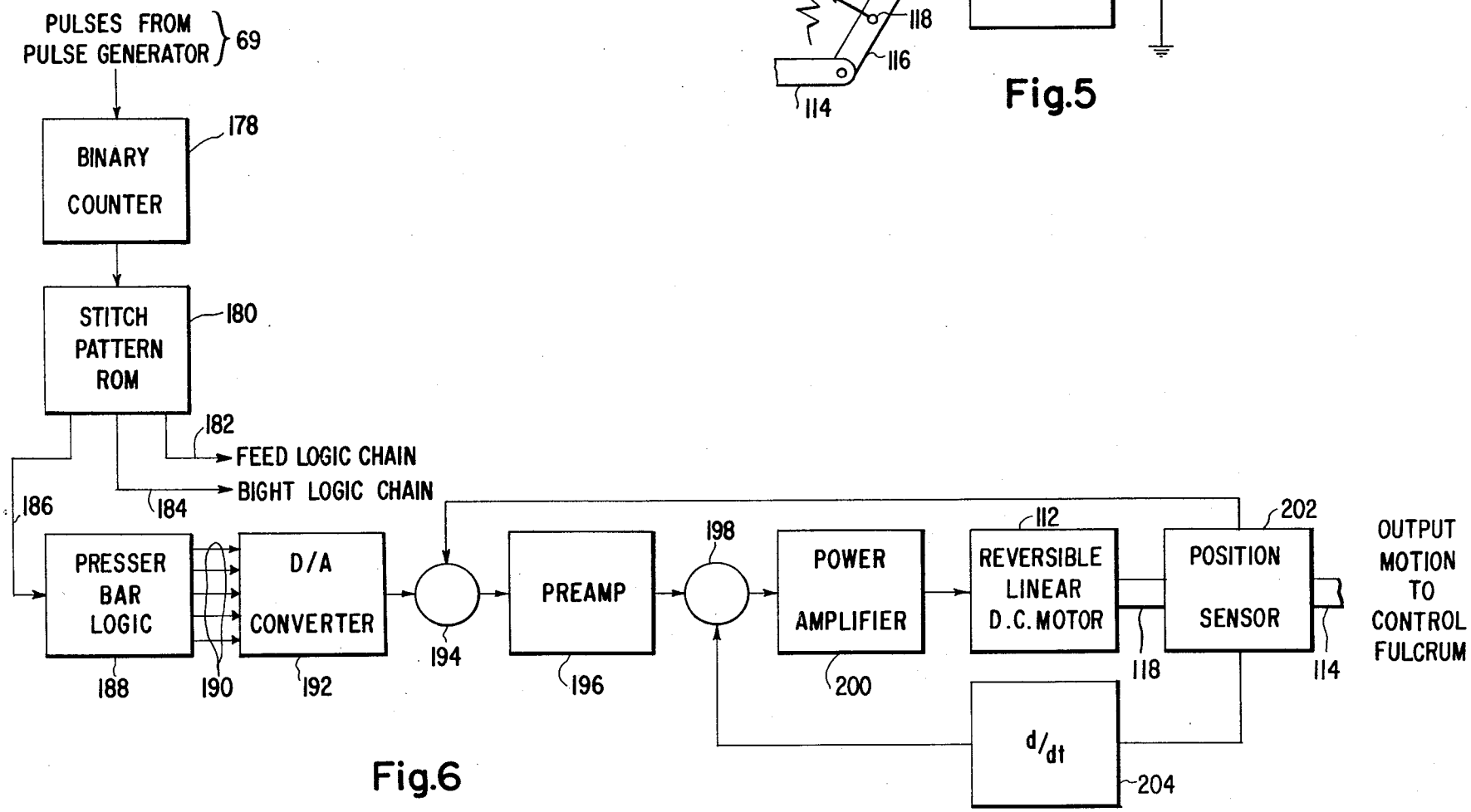
FIG. 6 is a block diagram of a logic circuit for automatically controlling operation of the presser bar motor.

FIG. 6 shows an automatic circuit for controlling the operation of the linear motor 112. This circuit is substantially the same as those shown in U.S. Pat. No. 3,984,745 for operating the motors to control the feed and bight.

The circuit in FIG. 6 receives pulses from the pulse generator 69 to a binary counter 178 that keeps track of stitch numbers. The output of the binary counter is connected to a stitch pattern ROM 180 that supplies signals to the feed logic chain 182 and the bight logic chain 184 in the same manner as is disclosed in U.S. Pat. No. 3,984,745, supra. In the present case, the feed logic chain 182 supplies signals to control the motor 44 and the bight logic chain supplies signals to control the motor 68.

The stitch pattern ROM 180 also supplies, in the present case, an output signal at a terminal 186 connected to a presser bar logic circuit 188. This circuit supplies digital signals over a connecting link 192 to a digital-to-analog (D/A) converter 192. The D/A converter supplies analog signals to a summing circuit 194 at the input to a preamplifier 196. The latter supplies signals to another summing circuit 198 at the input to a power amplifier 200 to control the operating power to the reversible DC linear motor 112.

The linear motor 112 controls the actuating link 114 in a manner described in the previous figure, but the only part of the linkage shown in FIGS. 6 is the shaft 118 that controls a positioning sensor 202. The sensor 202 includes the potentiometer 120 along with circuits to provide two feedback signals, one to the summing circuit 194 and the other to a differentiating circuit 204 that supplies a differentiated signal to the summing circuit 198.

In the operation of the circuit in FIG. 6, signals from the pulse generator 69 are counted in the counter 178 to supply a output signal to control the stitch pattern ROM 180 for individual stitches or patterns thereof, either singly or in succession. The output terminal 186 of the ROM receives a digital signal determined by the ROM program in accordance with the selected stitch pattern. This signal may control the operation of the actuating link 114 to vary the pressure on the presser bar 80 or 160 on a stitch-by-stitch basis or to cause the pressure to be constant for an entire pattern but different for one pattern than for another.

The output of the position sensor 202 to the summing circuit 194 allows the summing circuit to form an error signal by comparing the sensor signal with the analog signal from the D/A converter 192. This error signal is amplified by the preamplifier 196 and applied through the summing circuit 198 to the power amplifier 200 to control the operation of the reversible linear DC motor 112 and thereby the operation of the actuating link 114. The differentiated position signal formed by the differentiating circuit 204 is a velocity signal and provide an error velocity control signal to the power amplifier 200.

As may be seen most clearly in FIGS. 2A and 2B, operation of the motor 112 in response to the circuit in FIG. 6 shifts the actuating link 114 to the left or right and thereby shifts the position of the fulcrum 106. This varies the relative lengths of the lever arms between the fulcrum 106 and the two balls 86 and 96. The spring 88 provides a known upward pressure on the right hand end of the lever 98, and the resulting downward pressure on the presser bar 80 is a function of this upward pressure and of the mechanical advantage of the lever 98 as determined by the location of the shiftable fulcrum 106. The signals stored in the ROM 180 in FIG. 6 are selected to be utilized in the presser bar logic 188 to generate signals that take into account the desired pressure on the presser bar 80 at any instant, the force supplied by the spring 88, and the available mechanical advantage that can be obtained by movement of the shiftable fulcrum 106 to any point within its range of travel. These parameters are then used to generate signals that emerge from the presser bar logic 188 in FIG. 6 and control the actuating link in FIG. 2A to shift the fulcrum 106 to whatever location may be necessary to effect the desired pressure on the presser bar 80.

While this invention has been described in terms of specific embodiments, it would be understood by those skilled in the art that modifications may be made therein within the true scope of the invention as determined by the following claims.

I claim:

1. In a sewing machine comprising a body, a feed mechanism for incrementally advancing a work piece to produce a series of stitches, and a presser bar with a presser foot attached thereto for urging said work piece into engagement with said feed mechanism, variable presser bar pressure control means comprising:

a rigid lever, said presser bar operatively engaging said lever at a first point on said lever;

means for applying a predetermined force to a second point on said lever spaced from said first point;

a shiftable fulcrum for said lever; and means for shifting said fulcrum along said lever to vary the mechanical advantage of said lever to control the pressure applied to said presser bar.

2. The variable presser bar pressure control arrangement as set forth in claim 1 in which said means for applying a predetermined force to a second point on said lever comprises resilient means between said lever and a fixed location with respect to said body.

3. The variable presser bar pressure control arrangement as set forth in claim 1 which further comprises means for varying said predetermined amount of said predetermined force applied to said lever to vary the range of pressure over which said variable presser bar pressure control arrangement may operate.

4. The variable presser bar pressure control arrangement as set forth in claim 1 in which said fulcrum engages said lever over a range of points between said first and second points under the control of said means for shifting said fulcrum.

5. The variable presser bar pressure control arrangement as set forth in claim 4 in which said means for applying a predetermined force to a second point on said lever comprises a spring connected to said body and exerting said predetermined force at said second point on said lever near one end of said lever, said arrangement further comprising a second spring connected between said body and a third point on said lever near the other end thereof.

6. The variable presser bar pressure control arrangement as set forth in claim 5 in which said first point on said lever at which said rigid lever is operatively connected to said presser bar is between said third point and any point in said range of points.

7. The variable presser bar pressure control arrangement as set forth in claim 1 in which said means for applying said predetermined force comprises:

spring biasing means; and means for constraining said spring biasing means relative to said lever.

8. The variable presser bar pressure control arrangement as set forth in claim 7 in which said means for constraining said spring biasing means comprises:

a first threaded member connected to said body; and a second threaded member threadedly engaging said first threaded member and connected to said spring to control the force exerted by said spring on said lever by rotation of one of said threaded bodies with respect to the other.

9. The variable presser bar pressure control arrangement as set forth in claim 1 which further comprises:

a first fulcrum-engaging surface on said lever substantially coincident with the path of shifting movement of said fulcrum; and a second fulcrum-engaging surface attached to said body, said fulcrum bearing against said second fulcrum-engaging surface, and said first fulcrum-engaging surface bearing against said fulcrum.

10. The variable presser bar pressure control arrangement as set forth in claim 9 in which said second fulcrum-engaging surface is substantially parallel to the direction of movement of said fulcrum.

11. The variable presser bar pressure control arrangement as set forth in claim 1 or 10 wherein said means for shifting the location of engagement of said fulcrum comprises a linear motor.

12. The variable presser bar pressure control arrangement as set forth in claim 9 in which said first and second fulcrum-engaging surfaces remain substantially fixed with respect to each other with respect to their mutual longitudinal directions, whereas said shiftable fulcrum is movable longitudinally with respect to said lever and said second fulcrum-engaging surface.

13. The variable presser bar pressure control arrangement as set forth in claim 9 wherein said fulcrum comprises roller means for engaging said first and second fulcrum engaging surfaces to facilitate the shifting of said fulcrum.

* * * * *